United States Patent [19]

Maucher et al.

[11] 4,422,256

[45] Dec. 27, 1983

[54] ADJUSTABLE CHEEK-PIECE FOR A SHOULDER FIREARM

[75] Inventors: Hans Maucher, Elchingen; Georg Zanner, Langenau; Otto Repa, Oberndorf, all of Fed. Rep. of Germany

[73] Assignee: Carl Walther GmbH, Ulm, Fed. Rep. of Germany

[21] Appl. No.: 387,660

[22] Filed: Jun. 11, 1982

[30] Foreign Application Priority Data

Jul. 24, 1981 [DE] Fed. Rep. of Germany ..... 3129182

[51] Int. Cl.[3] ..... F41C 23/00

[52] U.S. Cl. ..... 42/73

[58] Field of Search ..... 42/73, 72, 74, 71 R

[56] References Cited

U.S. PATENT DOCUMENTS

| | | | |
|---|---|---|---|
| 183,975 | 10/1876 | Rosee | 42/74 |
| 2,669,051 | 2/1954 | Cline | 42/71 R |
| 3,710,496 | 1/1973 | Packmayr et al. | 42/73 |
| 4,122,623 | 10/1978 | Stice | 42/73 |
| 4,203,244 | 5/1980 | Hickman | 42/73 |

*Primary Examiner*—Charles T. Jordan
*Assistant Examiner*—Ted L. Parr
*Attorney, Agent, or Firm*—Edmund M. Jaskiewicz

[57] ABSTRACT

A shoulder firearm, such as a sport rifle and the like, has a cheek-piece which is adjustable vertically and laterally with respect to the gunstock. Two spacer members are loosely positioned in correspondingly aligned bores or recesses in the cheek-piece and gunstock. Each spacer member has a plurality of pairs of opposed parallel surfaces and the distances between each pair of parallel surfaces are different. The spacer members may be in the form of blocks or cylindrical elements. By varying the placing of the spacer members in the recesses or bores of the cheek-piece and gunstock, the cheek-piece can be set at different heights.

11 Claims, 13 Drawing Figures

Fig. 1
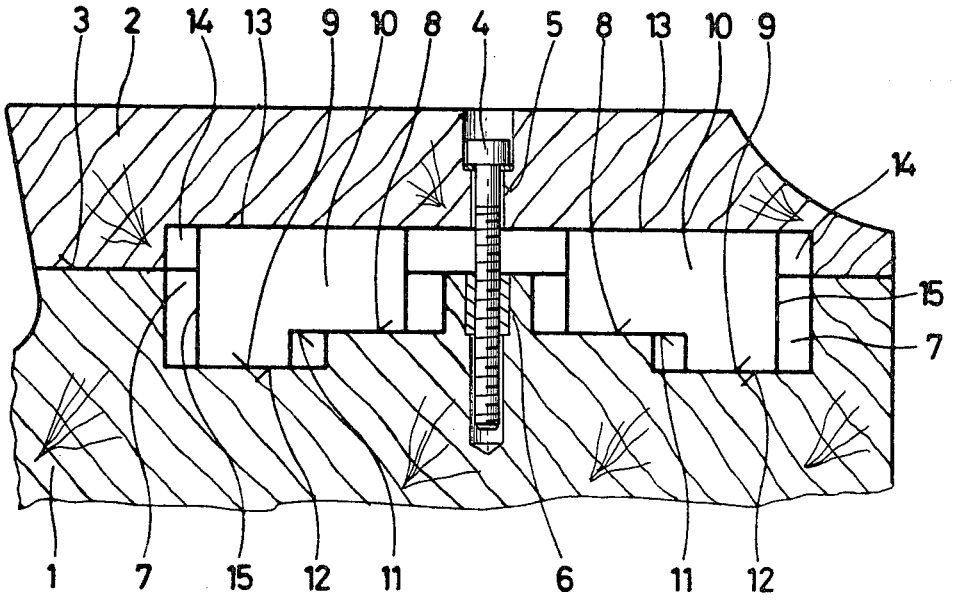
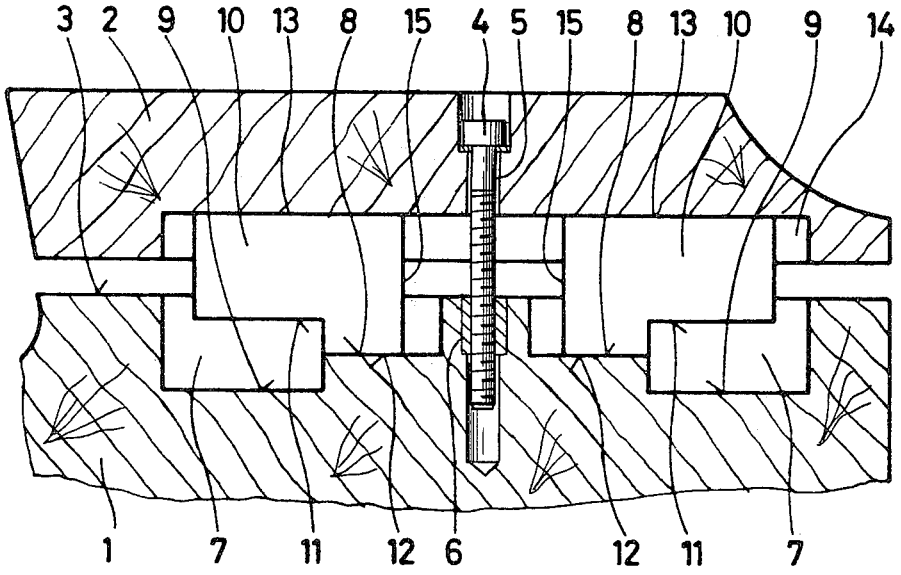
Fig. 2

ADJUSTABLE CHEEK-PIECE FOR A SHOULDER FIREARM

The present invention relates to a cheek-piece for sport firearms, more particularly, to a cheek-piece which is adjustable with respect to the gunstock.

Various types of firearms have often been provided with various adjustable features and structural details in order to adapt the firearm to match the anatomical or physical characteristics of the shooter. Shoulder firearms, such as a sport rifle or the like, have been provided with an adjustable cheek-piece which is of a great advantage when the shooter is sighting a target through the sights of the firearm. It is of a particularly great advantage if the cheek-piece can be adjusted in height with respect to the gunstock and also laterally.

One form of an adjustable cheek-piece is disclosed in the publication DE-GM No. 1 849 175. This cheek-piece has two guides which are received within corresponding slots in the gunstock. In order to adjust the height of the cheek-piece to be adapted to a particular individual who will handle the firearm, the cheek-piece can be raised after loosening a positioning screw and subsequently secured in the new position by tightening the same screw. However, this construction has the disadvantage that it is expensive and involves relatively high manufacturing costs. Further, according to the aforementioned publication, this cheek-piece cannot be adjusted laterally. In addition, this particular cheek-piece construction is not officially approved by all of the regulatory bodies concerned with sport firearms and does not meet all of the requirements of these relevant sport regulations.

It is therefore the principal object of the present invention to provide a novel and improved adjustable cheek-piece for firearms.

It is another object of the present invention to provide a cheek-piece which is adjustable both vertically and laterally with respect to the gunstock of a shoulder firearm or the like.

It is a further object of the present invention to provide such an adjustable cheek-piece which is simple to use, reliable in operation and inexpensive to manufacture.

According to one aspect of the present invention, a shoulder firearm such as a sport rifle or the like has a cheek-piece which is adjustable with respect to the gunstock. There is at least one spacer member positionable between a portion of the gunstock and the cheek-piece. Each spacer member has a plurality of pairs of opposed parallel surfaces and the distances between each pair of parallel surfaces are different.

Also according to the present invention, the spacer members may comprise a wooden block having a number of pairs of opposed parallel surfaces so as to define a plurality of stepped surfaces. The spacer member may also be cylindrical and comprising a cylindrical body from the end portions of which extend pin portions. Recesses or bores are provided in the gunstock and cheek-piece to receive the spacer members.

As a result of the present invention, the shooter can select one of several different height positions of the cheek-piece with respect to the gunstock in order to adapt the gun to his particular physical characteristics. The selection of a height position is accomplished by simply changing the positions of the spacer members. Since two spacer members are loosely positioned between the cheek-piece and the gunstock, the construction is simple and inexpensive. A further advantage of the present invention is that the spacer members used to adjust the vertical height of the cheek-piece can also be used with very minor structure modifications to adjust the cheek-piece laterally with respect to the gunstock. In addition, the adjustable cheek-piece of the present invention completely meets all known requirements of relevant sport regulatory bodies.

Other objects and advantages of the present invention will be apparent upon reference to the accompanying description when taken in conjunction with the following drawings, which are exemplary, wherein;

FIG. 1 is a longitudinal sectional view through a portion of a gunstock and adjustable cheek-piece according to the present invention showing the cheek-piece in its lowest, flush-fit position;

FIG. 2 is a view similar to that of FIG. 1 but showing the cheek-piece in a first raised position achieved by a setting of the spacer members;

Proceeding next to the drawing wherein like reference symbols indicate the same parts throughout the various views, a specific embodiment and modifications of the present invention will be described in detail.

Figure 3:
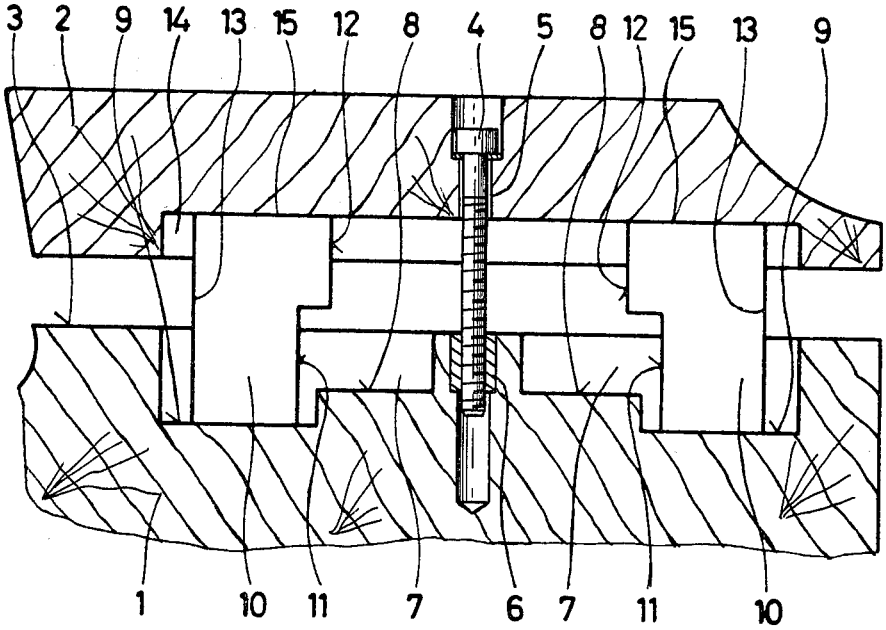
FIG. 3 is a view similar to that of FIG. 1 but showing the cheek-piece raised to a next higher position.

A shoulder firearm or a rifle, such as a sport rifle, has a gunstock 1, a portion of which is illustrated in FIG. 1. The firearm is of the well-known rifle construction and need not be described in further detail.

An adjustable cheek-piece 2 is positioned on an upper surface 3 of the gunstock 1 and is secured in position by a screw 4 which passes through a borehole 5 in the cheek-piece 2 to be received in a correspondingly threaded aligned bore 6 in the gunstock 1. This screw fastener construction enables the cheek-piece to be securely attached to the gunstock but at the same time enables the cheek-piece to be readily detachable or removable.

The gunstock 1 is provided in its upper surface 3 with two recesses 7 positioned one on each side of the threaded bore 6. The bottom surface of each recess 7 is provided with a pair of substantially parallel stepped surfaces comprising a higher surface 8 and a lower surface 9. In each of the recesses 7 there is loosely positioned a spacer member 10, one face of which is provided with stepped surfaces 11 and 12 which correspond to the stepped surfaces 8 and 9 of recess 7.

Each spacer member 10 has an upper longer face 13 which is positioned within a recess 14 formed in the lower surface of the cheek-piece 2 and corresponding in shape and dimensions with the pair of recesses 7 in the gunstock. In this position of the spacer members 10, the cheek-piece 2 is positioned on the upper faces 13 of the spacer members 10 as well as upon the upper surface 3 of the gunstock 1. The stepped surfaces 11 and 12 of the spacer members 10 rest upon the stepped surfaces 8 and 9 of the recesses 7. In this setting of the spacer members, the cheek-piece 2 is in its lowest position in that it rests directly upon the upper surface of the gunstock. It is to be noted that a vertical or lateral surface 15 of the spacer member 10 is smaller than the upper face 13 of the spacer member. It is to be noted also that both spacer members 10 are identical in size and shape.

In order to position the cheek-piece 2 in its next higher position, the positioner screw 4 is unscrewed and the cheek-piece 2 is removed. The spacer members 10 are then pivoted in a horizontal plane through an angle of 180° so that the stepped surface 12 of each spacer member 10 rests upon stepped surface 8 of corresponding recess 7. The relationship of the stepped surfaces 8 and 9 of a recess 7 is such with respect to the stepped surfaces 11 and 12 of a spacer member 10 that when spacer member surface 11 rests upon recess stepped surface 8 the spacer member surface 12 rests upon recess stepped surface 9. Both stepped surfaces at 11 and 12 of the spacer member 10 are parallel to the opposed surface 13 as a result of which the positioning of the spacer members, cheek-piece and gunstock is achieved as illustrated in FIG. 1 and succeeding drawings.

The cheek-piece 2 is raised to a further higher position by positioning the spacer members 10 so that one lateral or end surface rests upon the lower stepped surface 9 of the recess 7 and the other lateral or end surface 15 is positioned against the bottom surface of recess 14 in the cheek-piece 2. These positions of the spacer members 10 are illustrated in FIG. 3.

Figure 4:
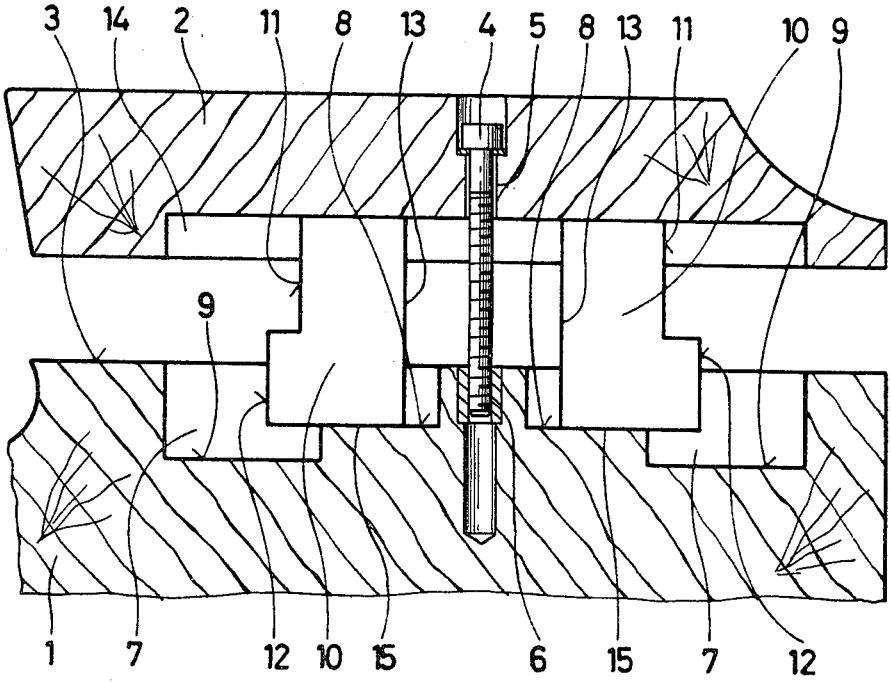
FIG. 4 is a view similar to that of FIG. 1 and showing the cheek-piece raised to its highest adjusted position.

The cheek-piece 2 is positioned in its highest position with respect to the gunstock 1 when the spacer members 10 are positioned on the upper stepped surfaces 8 of recesses 7 as shown in FIG. 4.

It is respectfully pointed out that while each spacer member 10 has been shown as having two stepped surfaces corresponding with a like number of stepped surfaces in the recesses 7 it is to be understood that each spacer member may be provided with a greater number of stepped surfaces which can correspond with a similar like greater number of stored surfaces in the recesses 7. With such a structure having a greater plurality of pairs of opposed parallel surfaces, the cheek-piece 2 may be adjusted and positioned in a greater number of vertical positions with respect to the gunstock 1. The spacer members or blocks 10 may be made of wood or a suitable plastic.

Figure 5:
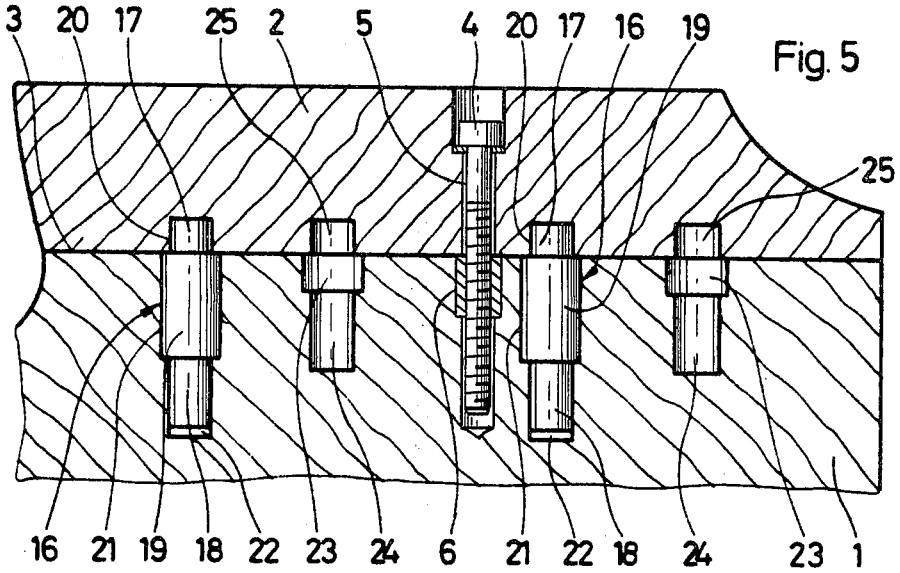
FIG. 5 is a view similar to that of FIG. 1 but showing a modification in the spacer member structure for adjusting the cheek-piece.

In FIG. 5, there is illustrated a modification of the present invention wherein the spacer members are cylindrical as indicated at 16. Each spacer member 16 has a cylindrical body from the opposed ends of which extend cylindrical pin portions 17 and 18 which are of a like diameter but which are smaller in diameter than the cylindrical body portion 19 of spacer member 16. Also, as may be seen in FIG. 5, the pin portion 17 is shorter than the pin portion 18. For purposes of reference only, the end of the cylindrical spacer member 16 having the pin portion 17 may be considered as the top and the pin portion 18 may be considered as extending from the bottom thereof. The lower surface of the cheek-piece 2 which rests upon the upper surface 3 of the gunstock 1 is provided with a pair of bores 20 which correspond in size and shape to the pin portion 17 so as to readily receive these pin portions as shown in FIG. 5. The upper surface 3 of the gunstock 1 is provided with a pair of bores 21 which are stepped to provide an upper portion with a diameter to accommodate the cylindrical body portion 19 of a cylindrical spacer member 16 and a smaller diameter bore 22 which corresponds to the diameter of the lower pin portion 18. With this modification, using the cylindrical spacer members, the cheek-piece 3 is shown in FIG. 5 in its lowest position with respect to the gunstock 1.

Figure 6:
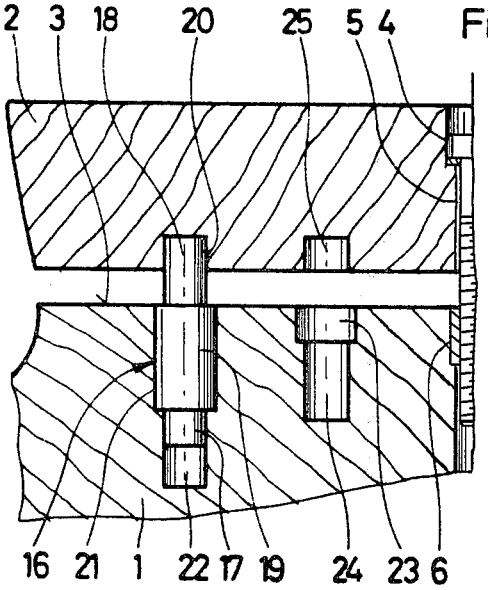
FIG. 6 is a view of a portion of the structure in FIG. 5 and showing the position of the cheek-piece after a cylindrical spacer member has been repositioned 180°.

When each spacer member 16 is pivoted around a horizontal axis through an angle of 180° and positioned in the aligned bores 22, 21 of the gunstock 1 and bore 20 of the cheek-piece 2, the cheek-piece is raised to a height as shown in FIG. 6.

In order to provide for an additional height adjustment of the cheek-piece 2, there are two additional bores 23, 24 in the gunstock 1 positioned adjacent to the bores 21, 22 as shown in FIG. 5. Each bore 23, 24 has the same diameters as the bores 21, 22 but have different lengths or depths as is clearly shown in FIG. 5. The cheek-piece 2 is similarly provided with an additional pair of bores 25 adjacent to and with the same dimensions as the bores 20. It is to be understood that the pairs of bores in cheek-piece 2 are in alignment with the bores in the gunstock 1 as may be seen in FIG. 5.

Figure 7:
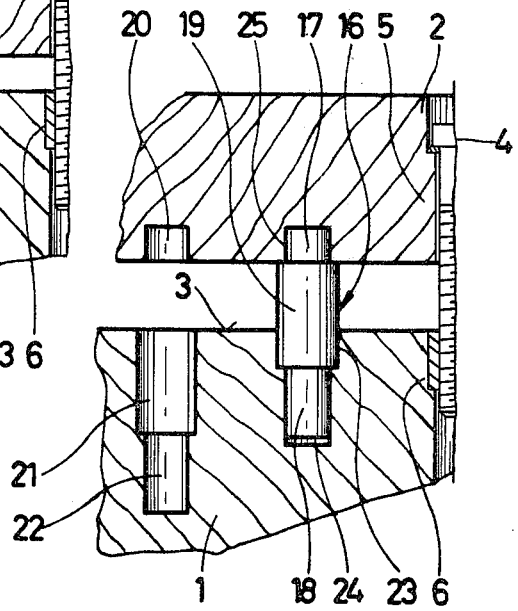
FIG. 7 is a view similar to that of FIG. 6 and showing a further raised position of the cheek-piece.

When the cylindrical spacer members 16 are positioned in the bores 23, 24 and 25 as shown in FIG. 7, the cheek-piece 2 may be adjusted to a greater height with respect to the gunstock 1.

Figure 8:
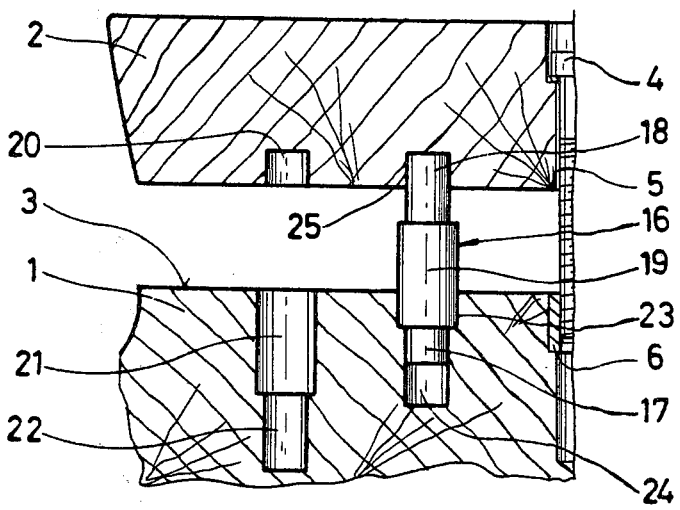
FIG. 8 is a view similar to that of FIG. 6 but showing the position of the cheek-piece after a 180 degree turn of the spacer member.

The cheek-piece may be adjusted to a still further height by pivoting each cylindrical spacer member 16 through an angle of 180° and then positioning the spacer members 16 in the bore holes 23, 24 and 25 as shown in FIG. 8.

Figure 9:
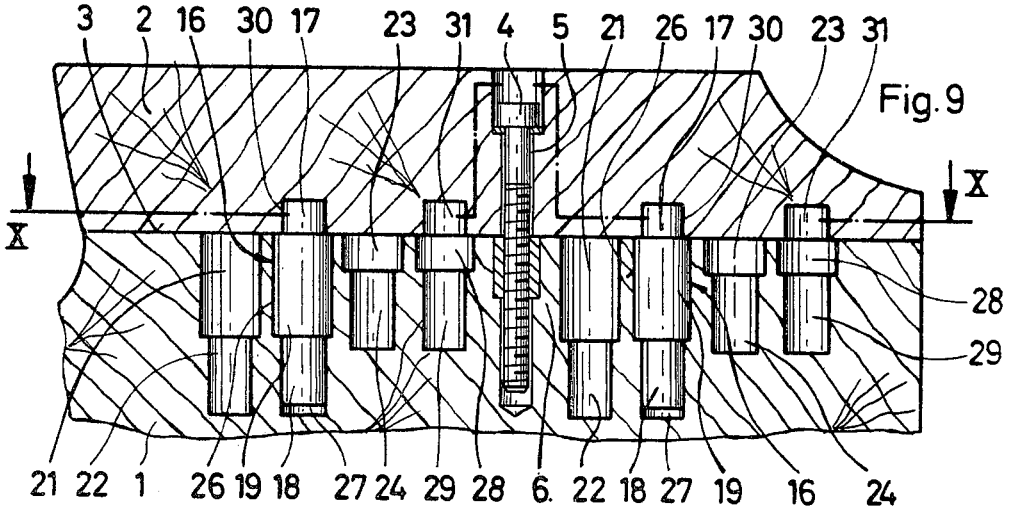
FIG. 9 is a longitudinal sectional view similar to that of FIG. 1 but showing an additional structure to provide for lateral adjustment of the cheek-piece.
Figure 10:
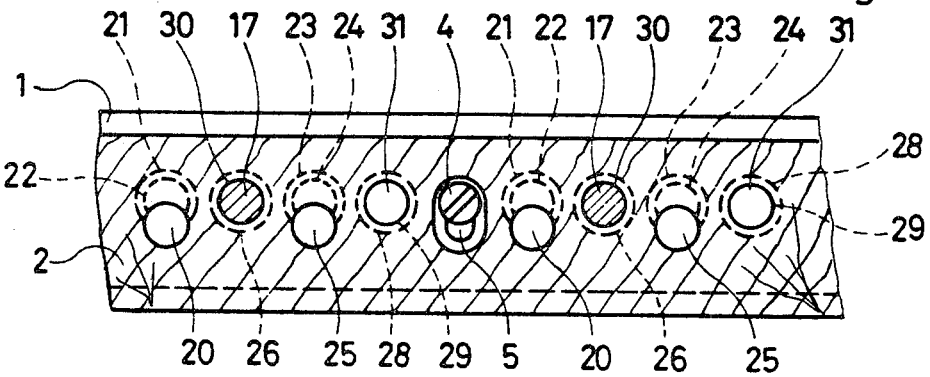
FIG. 10 is a sectional view taken along the line X—X of FIG. 9.

The present invention also provides for the lateral adjustment of the cheek-piece with respect to the gunstock 1 in each of its adjusted vertical positions. To achieve this lateral adjustment, additional pairs of bores 26, 27 and 28, 29 are positioned adjacent to the respective bores 21, 22 and 23, 24 in the gunstock 1 as shown in FIG. 9. These additional bores have the same dimensions and correspond to the respective bores 21, 22 and 23, 24. The cheek-piece 2 is provided with bores 30 and 31 which have the same dimensions as the bores 20 and 25 but are laterally offset with respect to the bores 20 and 25 as may be seen in FIG. 10. When the cylindrical spacer members 16 are positioned in the bores 26, 27 of the gunstock 1 and the bores 30 of the cheek-piece 2 receive the pin portion 17 of the spacer member 16, the cheek-piece 2 will be in a laterally offset position with respect to the gunstock 1 as shown in FIG. 10. In order to permit this lateral positioning of the cheek-piece with respect to the gunstock, the bore 5 which passes through the cheek-piece for the screw 4 is elongated in a direction which is transverse to the longitudinal direction of the gun. Similarly, the recessed bore to accommodate the head of the positioning screw 5 must also be elongated as shown in FIG. 10.

When the cheek-piece 2 is laterally offset as shown in FIG. 10, the next higher position of the cheek-piece is achieved by pivoting the spacer members 16 through 180° in the bores 26, 27 and 30. This particular position of the cheek-piece 2 is not shown in the drawings, but the position corresponds to the height setting as shown in FIG. 6. When the cheek-piece 2 is laterally offset, an additional height setting is achieved by placing the spacer member 16 in the bores 28, 29 and 31. This position of the cheek-piece 2 is also not illustrated, but it corresponds to that shown in FIG. 7. By pivoting the spacer member 16 to 180° in the bores 28, 29 and 31, the next higher position of the cheek-piece 2 can again be achieved as shown in FIG. 8.

Figure 11:
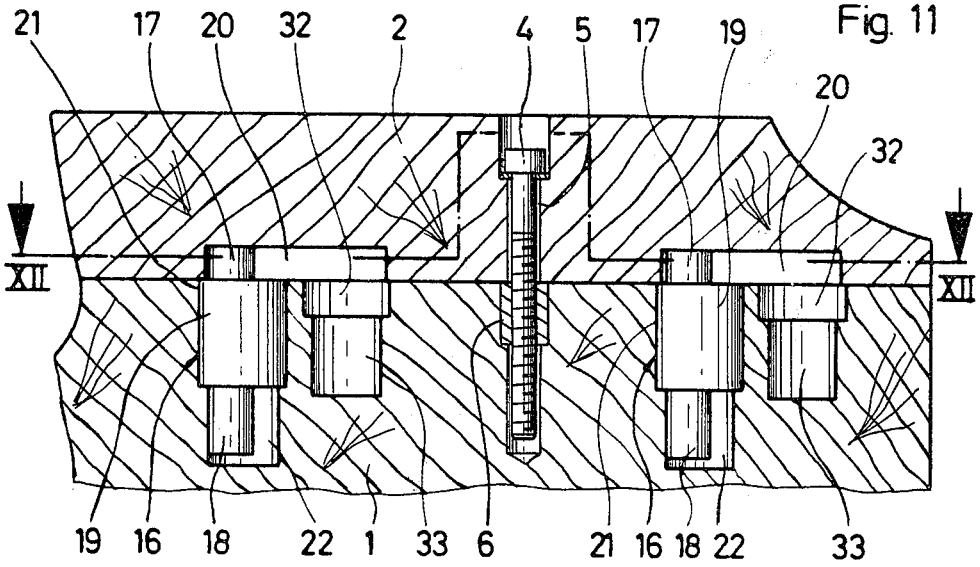
FIG. 11 is a view similar to that of FIG. 1 but showing a further modification to provide for lateral adjustment of the cheek-piece.
Figure 12:
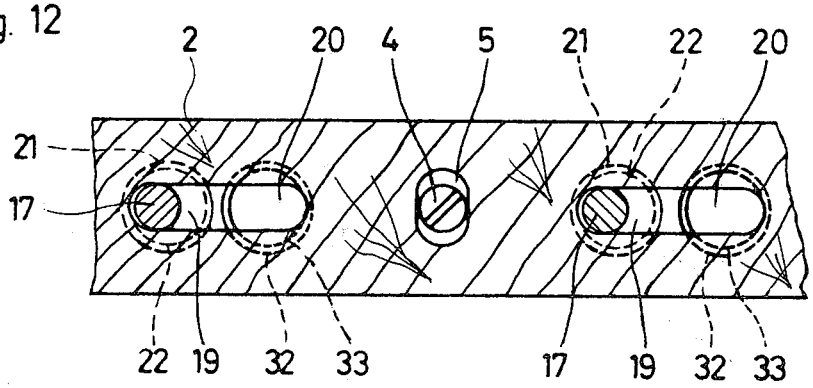
FIG. 12 is a sectional view taken along the line XII—XII of FIG. 11 showing the cheek-piece in its central lateral position.
Figure 13:
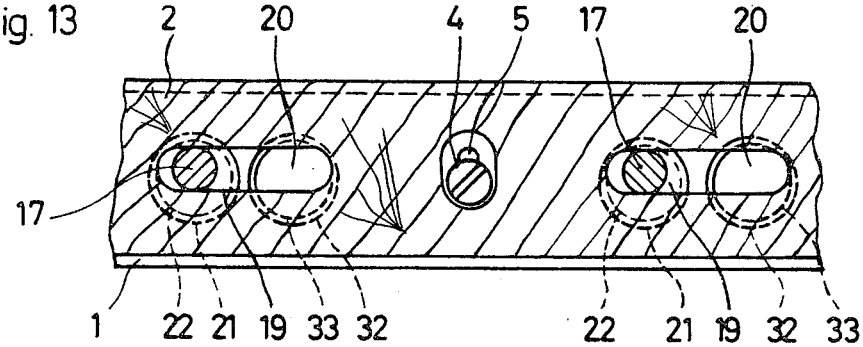
FIG. 13 is a view similar to that of FIG. 12 but showing the cheek-piece after a lateral adjustment thereof.

A modification in the structure for lateral adjusting of the cheek-piece 2 is shown in FIGS. 11, 12 and 13. In this modification, the end pin portions 17 and 18 of the cylindrical spacer member 16 are eccentrically offset with respect to the central cylindrical body portion 19. By pivoting the central body portion 19 in the bore 21 of the gunstock 1, the cheek-piece 2 will be displaced laterally as shown in FIG. 13. To accommodate the resulting longitudinal movement of the pin portion 17 the bore 20 in the cheek-piece 2 is elongated in the direction longitudinal of the firearm so as to take the shape of an elongated recess. For the same reason, the bore 22 in the gunstock 1 is greater than the diameter of the pin portion 18. Because of the lateral movement of the cheek-piece 2, through bore 5 in the cheek-piece 2 to accommodate the positioning screw 4 is in the shape of an elongated hole extending in a direction transversely to the longitudinal direction of the cheek-piece 2. The middle position of the cheek-piece 2 is shown in FIG. 12, and from this position the cheek-piece can be laterally adjusted to the left or right merely by pivoting the cylindrical spacer members 16 as described above.

The height adjustment of the cheek-piece 2, as shown in FIG. 11, is accomplished in the same manner as described with the other structures wherein the spacer members 16 are pivoted through 180° into the bores 21 of the gunstock 1. Additional height positions of the cheek-piece 2 are achieved by varying the positions of the cylindrical spacer members 16 and positioning them in the additional bore holes 32 and 33 in the gunstock 1. The bores 32 and 33 have the same diameter as the bores 21 and 22 but have a different depth or length. The length of the elongated bore 20 must be sufficient to allow pin portion 17 or pin portion 18 of the cylindrical spacer member 16 to be received into the elongated bore or recess 20 when placed in the bores 21, 22 and 32, 33. The next higher position of the cheek-piece is again obtained by pivoting the spacer member 16 through 180° into the bores 32, 33 and 20.

Thus, it can be seen that the present invention has provided a simplified and reliable structure for the vertical and lateral positioning of the cheek-piece with respect to the gunstock of the shoulder firearm. The adjusting structure is simple in construction and is relatively inexpensive to manufacture and to install on firearms.

It will be understood that this invention is susceptible to modifications in order to adapt it to different usages and conditions, and accordingly, it is desired to comprehend such modifications within this invention as may fall within the scope of the appended claims.

We claim:

1. In a shoulder firearm, a cheek-piece adjustable with respect to a gunstock, and at least one spacer member positionable between a portion of said gunstock and said cheek-piece, said spacer member having a plurality of pairs of opposed parallel surfaces and the distances between each pair of parallel surfaces being different, each of said pairs of surfaces being positionable between the cheek-piece and the portion of the gunstock such that the distance between the cheek-piece and the gunstock can be varied to correspond to the distance between the pair of surfaces interposed between the gunstock and cheek-piece.

2. In a shoulder firearm, as claimed in claim 1, wherein said gunstock has a recess in which said spacer member is moveably positioned.

3. In a shoulder firearm, as claimed in claim 2, wherein there are two spacer members both being positioned in said recess, a one face of each of said spacer members having first and second stepped surfaces corresponding to third and fourth stepped surfaces in said recess, there being a pair of said third and fourth stepped surfaces in said recess.

4. In a shoulder firearm, as claimed in claim 3 and further comprising a detachable screw disposed between said pair of stepped surfaces in said recess to secure said cheek-piece to said gunstock.

5. In a shoulder firearm, as claimed in claim 1, wherein there are two spacer members each comprising a cylindrical body, each cylindrical body having opposed ends and from each end extends a pin portion to define a pair of stepped surfaces, the pin portions from opposed ends having a same diameter which is less than the diameter of said cylindrical body, there being a first pair of correspondingly shaped first bores in said gunstock to receive said cylindrical spacer members, there being a pair of second bores in said cheek-piece to receive at least pin portions of said cylindrical spacer members.

6. In a shoulder firearm, as claimed in claim 5, wherein there is a pair of third bores in said gunstock having the same diameters as said first bores therein but having a different length, said cheek-piece having a pair of fourth bores opposed from said third bores.

7. In a shoulder firearm, as claimed in claim 6, wherein said gunstock has a second pair of said first bores disposed laterally of said first pair of first bores therein and a second pair of third bores disposed laterally of said first pair of third bores therein.

8. In a shoulder firearm, as claimed in claim 7, wherein said cheek-piece has a second pair of second bores spaced laterally of said first pair of second bores therein, and a second pair of fourth bores spaced laterally from said first pair of fourth bores therein.

9. In a shoulder, firearm, as claimed in claim 5, wherein the pin portions are eccentrically disposed on the opposed ends of said cylindrical body, said second bores in said cheek-piece being elongated in the longitudinal direction of the firearm, said first bores in said gunstock having a diameter greater than the diameter of said pin portions, there being aligned bores in said cheek-piece and gunstock to receive a detachable screw therein to secure said cheek-piece to said gunstock, said aligned bores being elongated in a direction at right angles to the longitudinal direction of the firearm.

10. In a shoulder firearm, as claimed in claim 1, and further comprising means for adjustably positioning said cheek-piece laterally with respect to said gunstock.

11. In a shoulder firearm, as claimed in claim 1, wherein said spacer members comprise wooden blocks.

* * * * *